United States Patent [19]

Kruse et al.

[11] Patent Number: 4,856,398

[45] Date of Patent: Aug. 15, 1989

[54] COUNTERTOP BREAD SLICER WITH MANUALLY ACTUATED CRADLE

[75] Inventors: Gary L. Kruse, Spring Lake; Bernard L. Petersen, Grand Rapids, both of Mich.

[73] Assignee: Oliver Products Company, Grand Rapids, Mich.

[21] Appl. No.: 147,230

[22] Filed: Jan. 22, 1988

[51] Int. Cl.[4] ..... B26D 1/11; B26D 7/06

[52] U.S. Cl. ..... 83/425.2; 83/437; 83/751; 83/435.1; 83/425.3

[58] Field of Search ..... 83/425.2, 437, 435.1, 83/425.3, 751, 858; 74/98

[56] References Cited

U.S. PATENT DOCUMENTS 633,863 9/1899 Lillpop ..... 83/858

2,789,606 4/1957 Solomon .

3,245,447 4/1966 Jones ..... 83/167

4,576,074 3/1986 Van der Togt ..... 83/358

4,662,257 5/1987 Peterson et al. ..... 83/751

*Primary Examiner*—Donald R. Schran

*Attorney, Agent, or Firm*—Price, Heneveld, Cooper, DeWitt and Litton

[57] ABSTRACT

The specification discloses a countertop bread slicer having a horizontal blade assembly, a cradle for carrying a loaf upwardly through the assembly, and a unique cradle-transportation mechanism. The mechanism includes a gear linkage and a cradle-support arm and a handle arm extending therefrom. The gear linkage provides a mechanical advantage so that relatively small movement of the handle are results in relatively large movement of the cradle.

8 Claims, 3 Drawing Sheets

COUNTERTOP BREAD SLICER WITH MANUALLY ACTUATED CRADLE

BACKGROUND OF THE INVENTION

The present invention relates to bread slicers, and more particularly to countertop bread slicers including a horizontal blade assembly and a cradle for carrying individual loaves of bread upwardly through the blade assembly.

Countertop bread slicers have been developed for relatively low-volume retail applications, such as small bakeries, in-store bakeries, and delicatessens. Three such slicers are illustrated in U.S. Pat. 4,662,257 issued May 5, 1987 to Petersen et al entitled COUNTERTOP BREAD SLICER; U.S.Pat. No. 4,576,074 issued Mar. 18, 1986 to Van der Togt entitled APPARATUS FOR SLICING BREAD PRODUCTS; and U.S. Pat. No. 2,789,606 issued Apr. 23, 1957 to Solomon entitled BREAD SLICING MACHINE.

Typically, countertop slicers include a horizontal blade assembly, a cradle for carrying individual loaves upwardly through the blade assembly, and a transportation mechanism for driving the cradle. The cradle transportation mechanisms developed to date, as evidenced in the cited patents, are relatively complicated, expensive, and/or bulky. Consequently, initial construction and subsequent service can be difficult and therefore expensive. Further, the space required by these mechanisms cause the slicer to occupy more counter space than is desirable in certain installations.

SUMMARY OF THE INVENTION

The aforementioned problems are overcome in the present invention wherein a countertop bread slicer is provided incorporating a relatively simple and small, yet efficient and reliable, cradle transportation mechanism. More specifically, the slicer includes a horizontal blade assembly, a bread cradle, and a novel transportation mechanism for propelling or driving the bread cradle. The transportation mechanism is manually actuated and includes a pair of cradle arms supporting the cradle and a handle which extends forwardly of the slicer through the bread infeed opening. The handle and cradle arms are pivotally supported on a gear linkage located in the rear of the slicer. The gear linkage insures that angular movement of the handle will result in greater angular movement of the cradle arm. Consequently, relatively small movement of the handle will result in full transportation of the cradle between its lower and upper positions.

In the preferred embodiment, the mechanical advantage is provided by way of intermeshing spur gears. The handle is fixedly connected to a relatively large spur gear; and the cradle arm is fixedly connected to a relatively small spur gear. The intermeshing spur gears therefore provide greater angular rotation of the smaller spur gear when moved.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
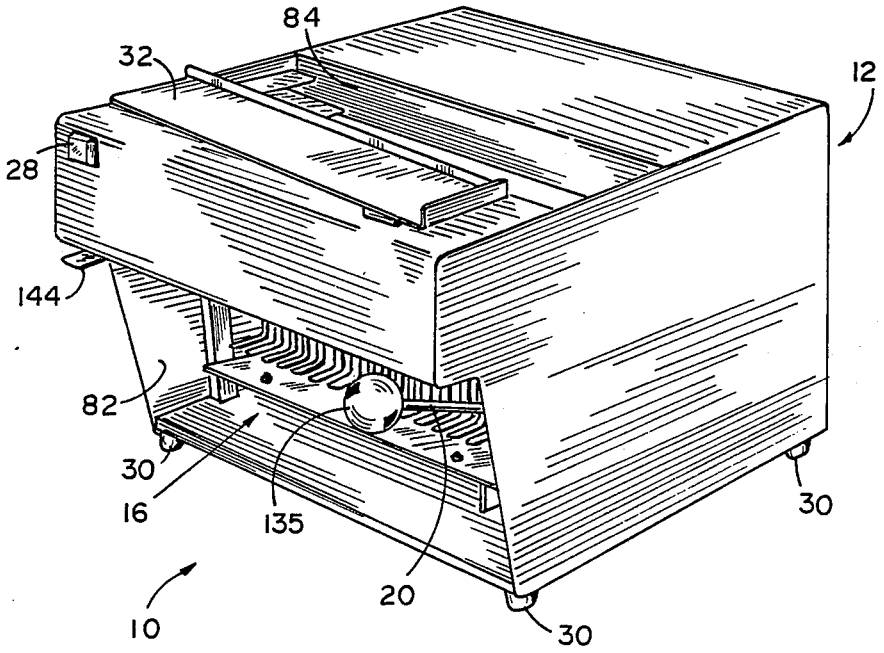
FIG. 1 is a perspective view of the countertop bread slicer of the present invention.

A bread slicer constructed in accordance with a preferred embodiment of the invention is illustrated in the drawings and generally designated 10. The slicer includes a housing/frame 12, a blade assembly 14, a cradle 16, and a transportation mechanism 18. The transportation mechanism 18 includes a handle 20 which is manually actuated to transport the cradle 16. In use, a loaf is sliced by first pulling handle 20 upwardly which lowers the cradle 16 to its lower position, placing a loaf of bread on the cradle 16, actuating the blade assembly 14, and pushing the handle 20 downwardly which carries the cradle 16 upwardly to push the loaf through the blade assembly 14 to be cut transversely into slices.

Figure 2:
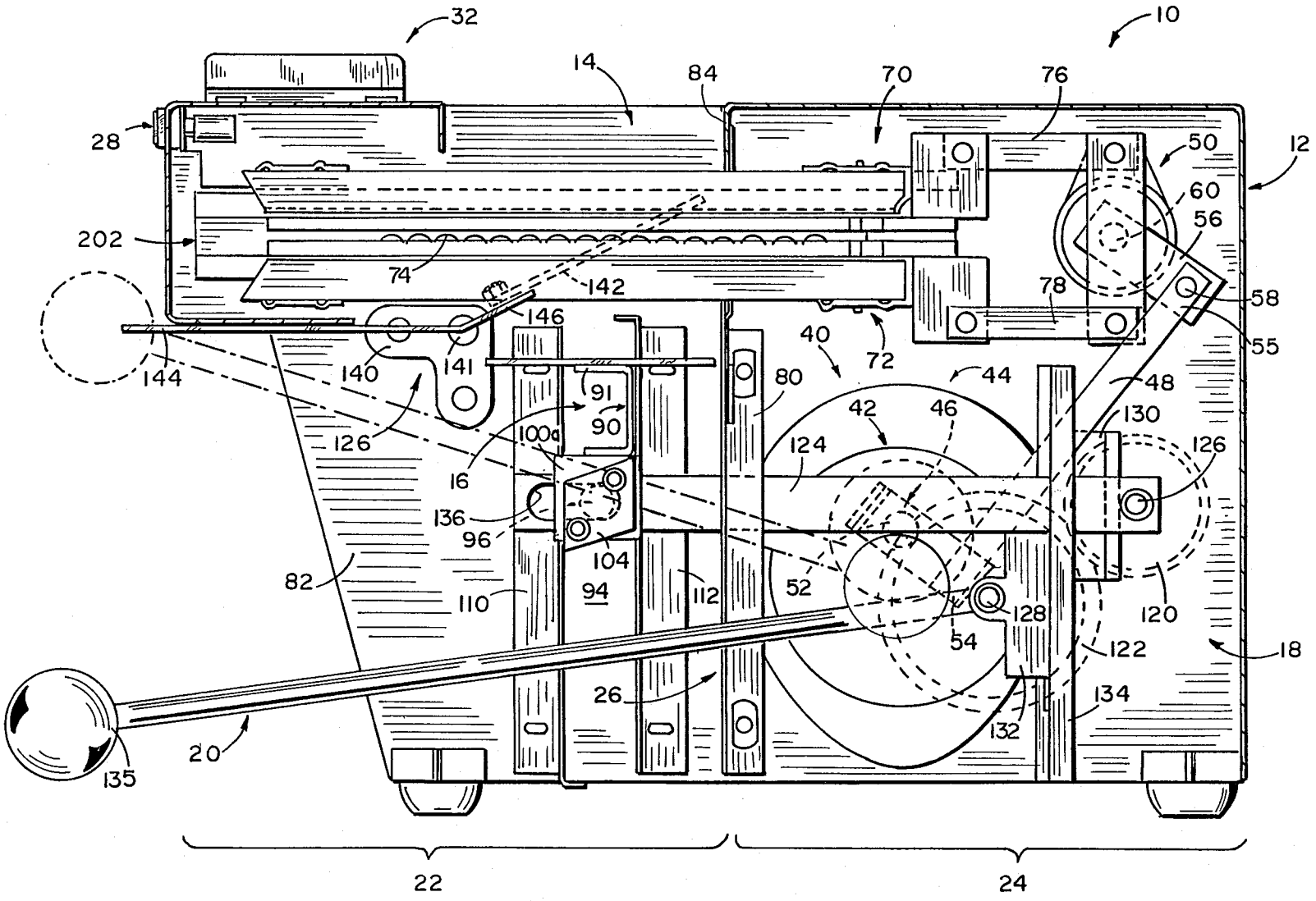
FIG. 2 is a partially sectional side elevational view of the bread slicer.

The housing/frame 12 (see primarily FIG. 2) includes a forward portion 22 and a rear portion 24 separated by the infeed table 26. A start/stop switch 28 is mounted in the forward portion 22 of the housing 12. A plurality of feet 30 are supported by the housing 12 to cushion the slicer on a countertop. A bagging scoop 32 of conventional design is mounted on the forward portion 22 of the housing 12 to facilitate bagging of the sliced loaves in a conventional manner.

The blade assembly 14 and the blade drive mechanism 40 are generally well known to those having ordinary skill in the art. Generally speaking, the drive mechanism 40 includes a motor 42, a gear reducer 44, an eccentric 46, a connecting rod 48, and a rocker 50. The motor 42 drives the gear reducer 44 so that the output axle 52 of the gear reducer is driven at 107 to 128. revolutions per minute (RPM). The eccentric 46 is fixedly mounted on the axle 52 for rotation therewith and pivotally supports the rod 4s at the lower rod end 74. The opposite or upper end 55 of the rod is pivotally mounted to the connecting block 56 at point 58. The connecting block 56 in turn is fixedly secured to the rocker 50. The rocker 50 is pivotally supported on a shaft 60 and oscillates thereabout when driven by the rod 48. Each blade frame has approximately a three-inch stroke so that the blade speed is approximately 642 to 768 inches per second.

Figure 3:
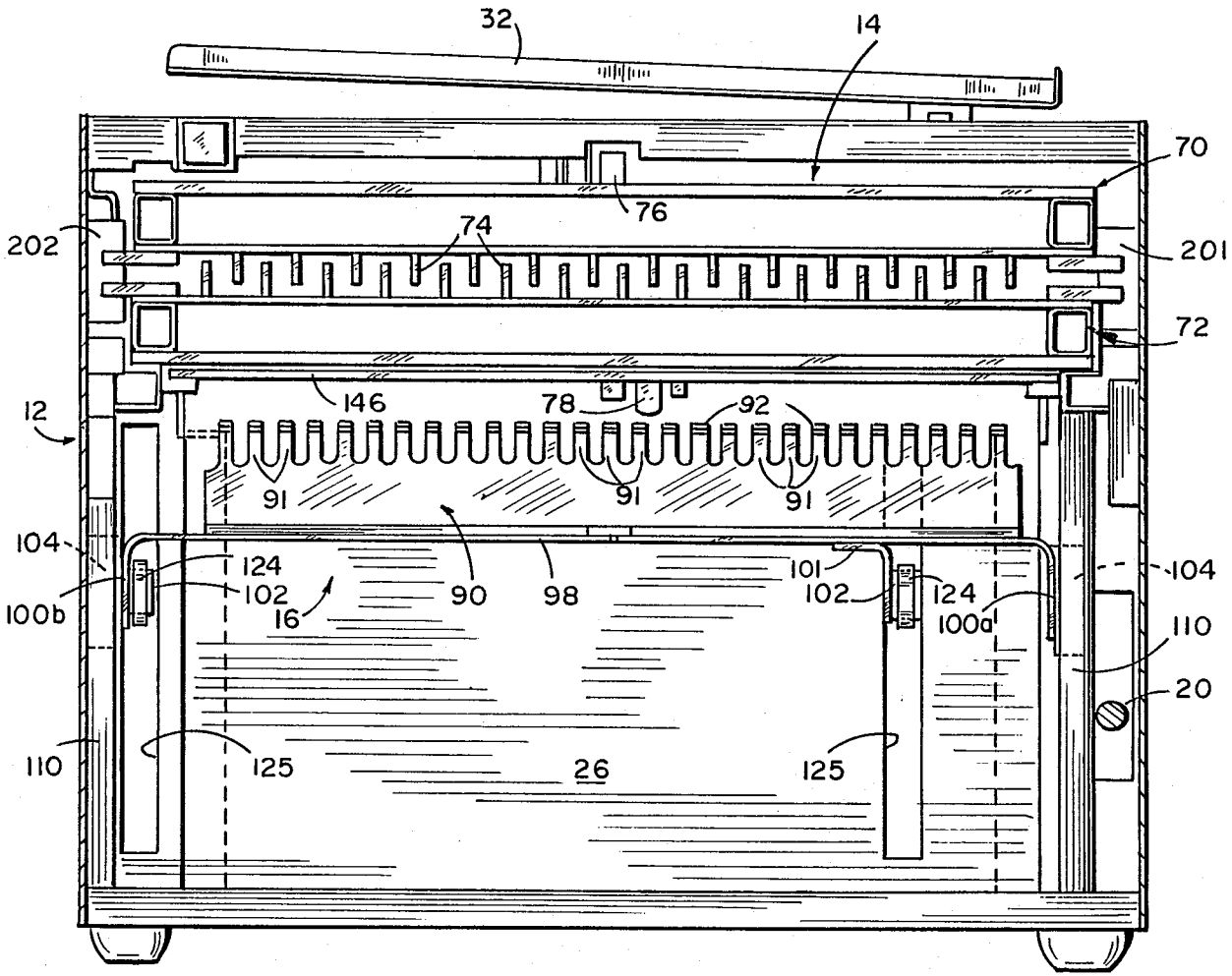
FIG. 3 is a partially sectional front elevational view of the bread slicer.

The blade assembly 14 (FIG. 2) includes an upper blade frame 70 and a lower blade frame 72 each supporting a plurality of knives or blades 74. The frames 70 and 72 are each pivotally secured at one end to rocker 50 on links 76 and 78, respectively, to oscillate with oscillation of the rocker. The frames 70 and 72 are each supported at their sides in the tracks 201 and 202 (see also FIG. 3) mounted on opposite sides of the housing 12. Consequently, frames 70 and 72 oscillate in opposite directions when driven by the rocker mechanism 50.

The infeed table 26 (FIG. 2) is mounted on mounting angles 80 which are secured to the housing 12. The infeed table 26 divides the housing 12 into a forward portion 22 and a rearward portion 24. The forward portion 22 in turn defines an infeed opening 82 through which a loaf can be inserted and placed on the cradle 16. The forward portion 22 further defines an outfeed opening 84 located immediately above the blade assembly 14 through which the loaf exits the slicer following slicing. The rear portion 24 is substantially enclosed by the housing 12 and the infeed table 26 to enclose the drive mechanism 40.

The cradle 16 supports a bread loaf during slicing. Generally speaking, the cradle includes a cradle bracket 90, a plurality of fingers 92, slide blocks 104, and rollers 96. The cradle bracket 90 is generally C-shaped in cross section (see FIG. 2) and opens toward the forward portion of the slicer 10. The cradle bracket 90 extends the full width of the blade assemblies 70 and 72 and includes a plurality of evenly spaced, L-shaped tabs along its upper portion. The tabs form the upper portion of the C-shaped cross section. The spaced tabs are formed by piercing the cradle bracket 90.prior to stamping the bracket into its C-shape. Each elongated finger 92 is welded to one of the tabs 91. Therefore, all of the fingers 92 are evenly spaced from one another to interfit with the blades 74 when the cradle is in its upper-most position. The cradle bracket 90 is supported on a support bar 98 which includes opposite down-turned ends 100*a* and *b*. A generally parallelogram-shaped slide block 104 is secured to the outside of each end 100*a* and *b*. An angle L 101 is welded to the underside of the cradle bracket 90. The angle L and the cradle bracket end 100*b* each support a roller 96 which interfit with the cradle support arms 124 as will be described.

A pair of mounting angles 110 and 112 (FIGS. 2 and 25 3) are mounted on opposite sides of the housing 12 and define a vertical linear slot 94 therebetween. In the preferred embodiment, the slot 94 is perfectly vertical so that the path of the cradle occupies as small a portion as possible of the depth of the slicer to decrease the "footprint" on the counter. The slide blocks 104 are closely received between the mounting angles 110 and 112 to guide the cradle 16 along its vertical linear path and also to maintain the angular orientation of the cradle so that the fingers 92 are substantially horizontal.

The cradle transportation mechanism 18 (see FIG. 2) includes first and second spur gears 120 and 122, a pair of cradle support arms 124, and the handle or handle arm 20. The spur gears 120 and 122 are fixedly secured to axles 126 and 128, respectively. The axles 126 and 128 are pivotally or rotatably supported within bearings 130 and 132, respectively, which in turn are fixedly secured to a support 134.

The handle 20 includes a knob 135 and is fixedly secured to the axle 128 for pivotal movement therewith. The handle 20 extends forwardly from the gear linkage 120, 122 to extend through the infeed opening 82 and thereby be accessible to a slicer operator located forwardly of the machine. Similarly, the pair of cradle support arms 124 are fixedly secured to the axle 126 for pivotal movement therewith. Each of the cradle support arms 124 extends through the slots 125 in the infeed table 26 to support the cradle 16. Each arm 124 defines an elongated slot 136 which receives the roller 96. Consequently, the roller is permitted to move within the slot 136 during movement of the cradle 16 which is confined to a linear path, while the arm 124 pivots.

The relative sizes of the spur gears 120 and 122 (FIG. 2) are distinctly different. Specifically, the diameter of the spur gear 122 is approximately 1.5 times greater than the diameter of the spur gear 120. This difference provides a mechanical advantage when the handle 20 is actuated. A relatively small angular movement of the handle 20 will result in a significantly greater angular rotation of the arms 124. Consequently, relatively small movement of the handle 20 will result in full transportation of the cradle 16 between its lower and upper positions. This is important in the presently preferred embodiment wherein the movement of the handle 20 is confined to the height of infeed opening 82.

Knife guide assembly 127 is pivotally supported between the opposite sides of the housing 12 in conventional fashion. The assembly includes a pair of pivot blocks 140 mounted on opposite sides of the housing 12, a fingered knife guide 142, and an actuating lever 144. The fingered knife guide 142 extends upwardly through the knives 74 and is fixedly secured to the flange 146 which extends between the pivot blocks 140. A torsion spring (not shown) at each end of the flange 146 urges the assembly in a clockwise direction as viewed in FIG. 2 to retain the knife guide 142 against the loaf of bread being sliced. The knife guide maintains the knives 74 in proper spaced relation to insure evenness of the slices, to maintain loaf position during slicing, and to insure that the cradle fingers 92 can pass upwardly through the knives. The hand lever 144 permits the knife guide assembly 142 to be rotated in a counterclockwise direction for visual inspection of the cradle 16 through the outfeed opening 84, for example during servicing.

Operation

The countertop slicer 10 easily, effectively, and precisely slices loaves of bread. The slicer is operated by a person or operator standing in front of the slicer (i.e. to the left of FIG. 2 or to the left and slightly forward of FIG. 1). The handle 20 and more particularly the knob 135 is grasped and lifted upwardly to the position illustrated in phantom in FIG. 2. As the handle 20 is lifted, spur gear 122 rotates in a clockwise direction as viewed in FIG. 2, and spur gear 120 rotates in a counter-clockwise direction. Consequently, the upward pivoting of the arm 20 results in the downward pivoting of the arms 124 and the bread cradle 16 is therefore lowered. The slide blocks 104 are in a position (not shown) at the bottom of the slot 94 when the handle 20 is in the position illustrated in phantom in FIG. 2.

The operator then inserts a loaf of bread through the infeed opening 82 and places the loaf on the cradle 16 and more particularly on top of the fingers 92. Preferably, the loaf is also placed against the infeed table 26 as the most desirable location for slicing.

While the operator's right hand is holding the handle 20, the operator's left hand is used to press the start/stop switch 28. A limit switch (not specifically shown) is included in conjunction with the axle 126 to insure that the handle is fully raised before the slicer motor can be actuated by the start/stop switch 28.

With the slicer operating, the operator then pushes the handle 20 downwardly to lift the cradle 16 upwardly. The mechanical advantage provided by the spur gears 120 and 122 enables the cradle 16 to be lifted fully to its upper position even with the relatively small movement of the handle 20. This mechanical differential also reduces the likelihood that the operator will inadvertently force the loaf through the slicer too rapidly. When the handle 20 has been pushed to its lowest position illustrated in FIG. 2, the cradle 16 is in its highest position (not shown) wherein the fingers 92 are located just above the knives 74. Consequently, the loaf is above the blades 74 and ready for bagging.

After the loaf has been sliced, the bread is removed from the outfeed opening 84 and bagged in conventional fashion using the scoop 32.

The above description is that of a preferred embodiment of the invention. Various changes and alterations can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. An improved bread slicer including a generally horizontal blade assembly, a bread cradle vertically movable between a lower position below said blade assembly and an upper position generally proximate said blade assembly, and a transport mechanism for transporting said bread cradle between said lower and upper positions, wherein the improvement comprises said transport mechanism comprising:

a first spur gear rotatable about a horizontal axis;

a cradle support arm extending radially from said first spur gear, said cradle support arm operably connected to said first spur gear so that said first spur gear and said cradle support arm rotate together, said cradle support arm operably connected to said bread cradle so that rotation of said cradle support arm causes vertical movement of said bread cradle;

a second spur gear rotatable about a horizontal axis and meshingly engaging said first spur gear, said second spur gear having a larger diameter than said first spur gear, whereby rotation of said second spur gear causes greater rotation of said first spur gear; and a handle arm extending radially from said second spur gear and operably connected thereto so that said second spur gear and said handle arm rotate together, whereby an angular deflection of said handle arm causes greater angular deflection of said cradle support arm.

2. An improved bread slicer as defined in claim 1 and further including a housing having a forward portion defining an infeed opening, said handle arm extending through said opening to be accessible forward of said opening.

3. An improved bread slicer as defined in claim 1 wherein said transport mechanism further comprises means for confining said bread cradle to a vertical linear path.

4. A bread slicer comprising:

a housing having a forward portion;

a horizontal blade assembly;

a cradle vertically reciprocable between a lower position below said blade assembly enabling a loaf of bread to be placed thereon and an upper position proximate said blade assembly; and a transport mechanism for transporting said cradle between the lower and upper positions, said transport mechanism including a gear linkage, a cradle arm pivotally supported by said gear linkage and operably connected to said cradle, and a handle arm pivotally supported by said gear linkage and extending toward said forward housing portion to be easily accessible by a slicer operator, said gear linkage providing a mechanical advantage between said cradle arm and said handle arm so that angular movement of said handle arm causes greater angular movement of said cradle arm, said gear linkage arranged to provide upward movement of said cradle in response to downward movement of said handle, whereby relatively small movement of said handle downwardly causes relatively large movement of said cradle upwardly.

5. A bread slicer as defined in claim 4 further comprising a housing having a forward portion defining an infeed opening below said blade assembly, said handle arm extending through said opening to be accessible forward of said opening.

6. A bread slicer as defined in claim 4 wherein said gear linkage includes a first spur gear fixed for rotation with said cradle arm and a second spur gear fixed for rotation with said handle arm, said first and second spur gears directly engaging one another.

7. A bread slicer as defined in claim 6 wherein said first spur gear is smaller in diameter than said second spur gear.

8. A bread slicer as defined in claim 4 wherein said transport mechanism includes means for confining movement of said cradle to a vertical linear path.

* * * * *

UNITED STATES PATENT AND TRADEMARK OFFICE

CERTIFICATE OF CORRECTION

PATENT NO. : 4,856,398

DATED : August 15, 1989

INVENTOR(S) : Gary L. Kruse and Bernard L. Petersen

It is certified that error appears in the above-identified patent and that said Letters Patent is hereby corrected as shown below:

Abstract of the Disclosure, Line 8;
"are" should be -- arm --;

Column 2, Line 40;
"rod 4s" should be -- rod 48 --;

Column 2, Line 40;
"rod end 74" should be -- rod end 54 --;

Column 3, Line 24;
"interfit" should be -- interfits --;

Column 3, Line 27;
"25 3)" should be -- 3) --.

Signed and Sealed this

Fourth Day of December, 1990

*Attest:*

HARRY F. MANBECK, JR.

*Attesting Officer*

*Commissioner of Patents and Trademarks*